US007007814B2

(12) United States Patent
Ploix

(10) Patent No.: US 7,007,814 B2
(45) Date of Patent: Mar. 7, 2006

(54) DISPLAY UNIT HAVING CANTILEVERED FIXED SHELVES AND RETRACTABLE FLAPS

(75) Inventor: Dominique Ploix, Paris (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 10/283,224

(22) Filed: Oct. 30, 2002

(65) Prior Publication Data

US 2003/0094428 A1 May 22, 2003

(30) Foreign Application Priority Data

Nov. 16, 2001 (FR) ..... 01 14838

(51) Int. Cl.
*A47F 5/00* (2006.01)

(52) U.S. Cl. ..... 211/187; 211/119.003; 211/90.02; 108/108

(58) Field of Classification Search ..... 211/187, 211/193, 119.003, 175, 90.02, 189, 190; 108/108, 108/109, 90, 73, 28
See application file for complete search history.

(56) References Cited

U.S. PATENT DOCUMENTS

| | | | | | |
|---|---|---|---|---|---|
| 4,068,855 | A | * | 1/1978 | Hakett | 211/189 X |
| 4,403,554 | A | * | 9/1983 | Valentine et al. | 211/189 X |
| 4,620,489 | A | * | 11/1986 | Albano | 108/108 X |
| 4,776,472 | A | * | 10/1988 | Rosen | 211/175 X |
| 4,865,283 | A | | 9/1989 | Parker | |
| 4,951,827 | A | | 8/1990 | Moransais | |
| 4,953,716 | A | * | 9/1990 | Rapoport | 211/175 X |
| 4,976,360 | A | * | 12/1990 | Zucker et al. | |
| D321,615 | S | * | 11/1991 | Lavine et al. | |
| 5,272,991 | A | * | 12/1993 | Carrigan | 211/193 X |
| 5,624,044 | A | * | 4/1997 | Black | 211/189 X |
| 5,813,741 | A | | 9/1998 | Fish et al. | |
| 5,947,307 | A | * | 9/1999 | Battaglia et al. | 211/187 |
| 6,364,137 | B1 | * | 4/2002 | Glauth et al. | |

FOREIGN PATENT DOCUMENTS

| | | |
|---|---|---|
| FR | 2 561 083 | 9/1985 |
| JP | 09 266 823 | 10/1997 |

* cited by examiner

*Primary Examiner*—Robert W. Gibson, Jr.
(74) *Attorney, Agent, or Firm*—Oblon, Spivak, McClelland, Maier & Neustadt, P.C.

(57) ABSTRACT

An advantageous display unit is provided in which one or more columns support plural shelves, at least some of which are mounted in a cantilevered fashion. According to a preferred form, one or more retractable flaps are provided which form sub-shelves to allow, for example, the display of product samples thereon. Preferably, the flaps are not only retractable, but also translatable so that their position can be varied along the length of the shelf. The arrangement allows for variety in the set up of the display unit, for example, by providing the ability to retract and deploy the flaps as needed and to vary the positioning of the flaps along the length of the shelves. Also, the overall set up of the display can be varied. For example, a single column arrangement can be provided with shelves disposed in a cantilever mount therefrom. A two (or more) column arrangement can also be provided with shelves extending between the columns, and further, with additional shelves disposed in a cantilever mount from one or both of the two columns.

52 Claims, 4 Drawing Sheets

DISPLAY UNIT HAVING CANTILEVERED FIXED SHELVES AND RETRACTABLE FLAPS

CROSS-REFERENCE TO RELATED APPLICATIONS

This application claims priority to French application 0114838 filed Nov. 16, 2001, the entire content of which is hereby incorporated by reference.

FIELD OF THE INVENTION

The present invention relates to display units for various articles. The invention is particularly advantageous for display units for hair coloring and care products, but can also be utilized for displaying other types of articles or products.

BACKGROUND OF THE INVENTION

Display assemblies having shelves for displaying articles or products are well known. Typically, such arrangements include a plurality of horizontal shelves which are spaced from one another vertically. However, conventional display units suffer from a number of disadvantages. For example, often it is desirable to display a sample product separately from other products so that the product can be readily identified as a sample. If a permanent sample shelf is provided, such a shelf is inconvenient if the display unit is later to be utilized for products in which no sample is provided. Also, conventional display units can be difficult to adapt to the space and positioning constraints which can vary greatly from location to location. Conventional display units can also be less than optimal with regard to their ability to change the appearance of the display, where it is desired to change the overall appearance of the display, or to make even minor changes such as the use or positioning of the sample holding flaps or sub-shelves.

SUMMARY OF THE INVENTION

According to one the advantageous aspects of the invention, a display unit is provided having at least one column with at least two shelves cantilevered out from the column, and at least one retractable flap is carried by one of the shelves. The use of cantilevered shelves makes it possible to reduce the number of columns that are needed, and thus to reduce the number of component parts and the cost of the display unit. The cantilevered shelves can also improve the appearance of the unit. The retractable flaps may be used, for example, for presenting samples. Thus, the retractable flaps can provide a sub-shelf to set off one or more articles (e.g., samples) from the remainder of the articles disposed on the corresponding shelf.

According to a further aspect of the invention, when the retractable flap(s) is in a deployed position, it is cantilevered out from one of said shelves. In an example of a particular embodiment, at least one retractable flap is suitable for being moved under the shelf supporting it in the longitudinal direction of the shelf to thereby enable its position along the shelf to be modified. For example, the retractable flap may be suitable for sliding relative to a support mounted beneath the associated shelf, so as to be slidable along the longitudinal direction of the shelf This makes it possible to vary the presentation of articles over time, and also makes it easy to modify the arrangement of the flaps as a function of the nature of the articles on display. This arrangement can also serve to enable the display unit to be adapted to its environment or the location in which the display is placed.

According to a further aspect of the invention, display units that differ in appearance can be made using shelves and flap arrangements that are identical, thus making it possible to benefit from the economies of scale in manufacturing the display units. In other words, manufacturing efficiencies can be realized by providing display units that can be manufactured with essentially the same design, but which can be set up with different appearances as desired.

In accordance with one example of an advantageous embodiment of the invention, the display unit has two columns and three series of shelves with one of the series of shelves being supported by both columns simultaneously. Each of the other two series of shelves is supported in a cantilevered out position from a corresponding one of the columns. In this example in particular, a pelmet (a valence or cornice) may interconnect the top portions of the two columns.

According to a preferred aspect of the invention, the shelves can be arranged in numerous ways. For example, the display unit may have fewer shelves fixed between the two columns than it has shelves cantilevered out from each of the columns, thereby enabling an advertising or decorative panel to be fixed between the columns.

By way of example, each of the shelves can have at least two retractable flaps. These two flaps may be moved in opposite directions in order to be brought to or placed in their deployed configuration. For example, one of the flaps may be deployed forwards and the other rearwards. Such a configuration enables articles to be presented with different arrangements on opposite sides of the display unit, for example, with the front of the unit facing a shop window and the rear of the unit visible from inside a shop or a hairdressing salon.

The two retractable flaps for a given shelf may be of different sizes, for example with different widths, thereby increasing the variety of possible configurations. By way of example, one of the flaps may be 70 millimeters (mm) wide while the other flap may be twice as wide. Both flaps may have the same depth, but it is also possible to have flaps of different depths. Each shelf is preferably symmetrical in shape about a vertical plane containing its longitudinal axis.

According to a further preferred aspect of an example of the invention, a series of shelves that are cantilevered out from a given column may be arranged in such a manner as to cause the size of the retractable flaps to alternate in the vertical direction when the display unit is observed from the front. This arrangement can improve the appearance of the unit. In a particular embodiment of the invention, the columns have fixing or mounting elements enabling the shelves to be placed at differing heights as selected by the user, thus making it possible to adapt the spacing between shelves to match article sizes. For example, the lower shelves may be fitted at a larger spacing than the upper shelves, and tall spray cans may be placed on the lower shelves.

In another particular embodiment of the invention, the top face of each shelf includes at least one groove situated close to its front and/or rear edge, for example with respective grooves in the vicinity of each of or adjacent to its front and rear edges. Such a groove may serve to hold at least one advertising or information sheet or board, for example.

The display unit can also optionally have at least one stand at the bottom end of each column, with such a stand advantageously having a shell made by rotational molding.

The shelves and/or columns may be made, for example, of aluminum or can be partially formed of aluminum. By way of example, the shelves can be fixed to the columns by fasteners or mounts having, for example, one or more metal strength or support members together with decorations formed, e.g., of plastic materials. The metal strength or support member can include at least one generally T-shaped bracket formed, e.g., of two brackets that are spaced apart side by side. The two brackets may define a space between them for receiving the body of at least one screw whose head rests against the brackets so as to hold them in place on the column. The brackets may have a hole at one end for receiving a screw for holding the brackets, and thus the mount, to a shelf. Advantageously, the plastic material decoration is shaped so as to fit closely around the outside shape of the column.

BRIEF DESCRIPTION OF THE DRAWINGS

The invention will be better understood upon reading the following detailed description of non-limiting embodiments of the invention particularly when read in conjunction with the accompanying drawings in which.

DESCRIPTION OF THE PREFERRED EMBODIMENTS

Figure 1:
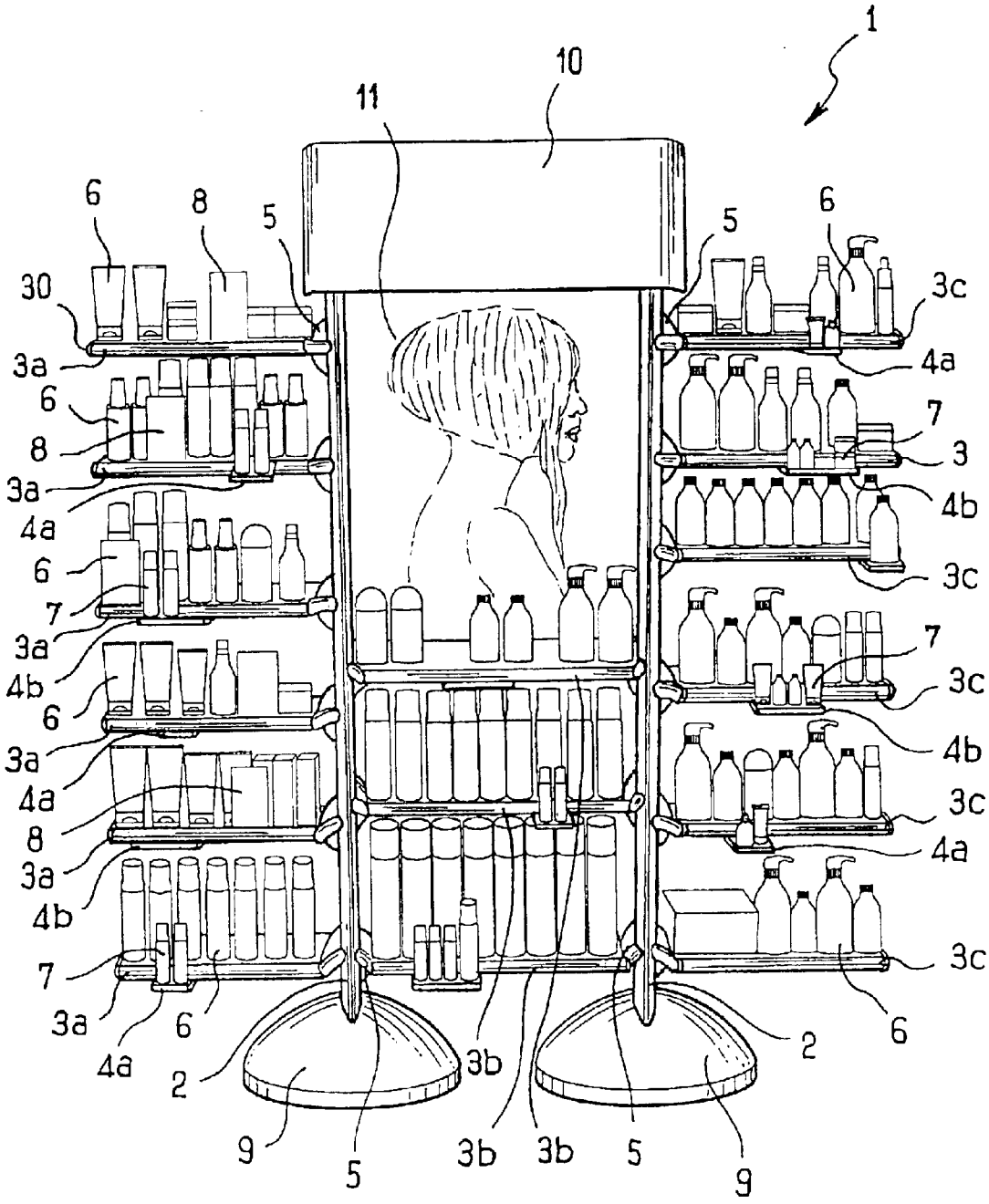
FIG. 1 is an elevation view of a display unit according to an exemplary first embodiment of the invention.

Referring now to the drawings, in which like reference numbers are used to designate the same or corresponding parts throughout the various drawings, it is to be understood that the illustrated embodiments are intended as examples. Accordingly, the illustrated embodiments should not be construed as limiting, as numerous variations are possible as will become apparent from the teachings herein. For example, the size, number, shape and positioning of different components can vary. In addition, although particular mounting or fastening expedients for the various components are disclosed herein by way of example, other mounting/fastening expedients could also be utilized.

The display unit 1 shown in FIG. 1 has two columns 2 and three series of shelves 3*a*, 3*b*, and 3*c* suitable for supporting articles 6. All of the shelves 3*a* are superposed, with six of the shelves illustrated in this example. As shown, the shelves 3*a* are cantilevered to extend out from the left-hand column 2. All of the shelves 3*c* are identical to the shelves 3*a*, there being six of them likewise illustrated by way of example, and they are superposed and cantilevered to extend out from the right-hand column 2. Between the columns, there are three shelves 3*b*, for example, and they are fixed to both columns 2 so as to extend between the columns 2. The shelves 3*a* and 3*c* extend in opposite directions in the FIG. 1 arrangement. In the example shown, the shelves 3*b* differ from the shelves 3*a* and 3*c* essentially by the fact that they are a little longer and by the fact that they are arranged to be fixed to both columns 2 instead of to a single column.

Each of the shelves 3*a*, 3*b*, and 3*c* may carry one or more retractable flaps, e.g., with one (or more) relatively narrow flap 4*a* and one (or more) relatively wide flap 4*b*. The flaps 4*a* and 4*b* can be used, for example, to put forward samples 7, as can be seen more particularly in FIG. 2. Other articles could also be provided on such flaps if desired, e.g., information or promotional literature. The flaps 4*a* and 4*b* are arranged in such a manner as to be capable of being pushed in under the shelves 3*a*, 3*b*, or 3*c*, as are the flaps 4*a* and 4*b* of the second and third shelves 3*a* in the left-hand column 2, starting from the bottom.

Figure 2:
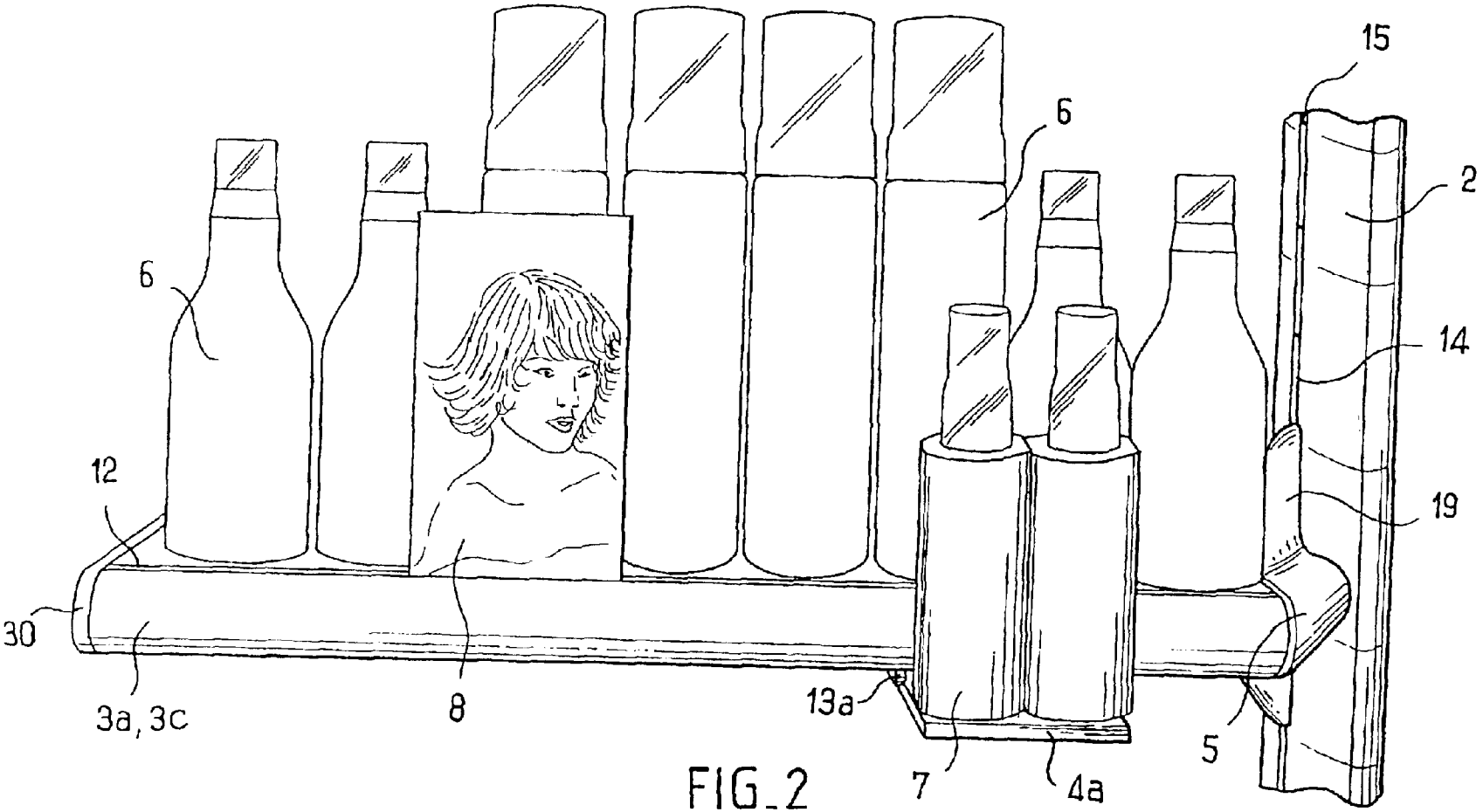
FIG. 2 shows one of the shelves of the FIG. 1 display unit in isolation.

Close to their front and rear longitudinal edges, the shelves 3*a*, 3*b*, and 3*c* preferably have longitudinal grooves 12 in their top faces, only one of which grooves is visible in FIG. 2. These grooves are suitable for receiving a display element such as an advertising or information sheet or board 8.

Figure 3:
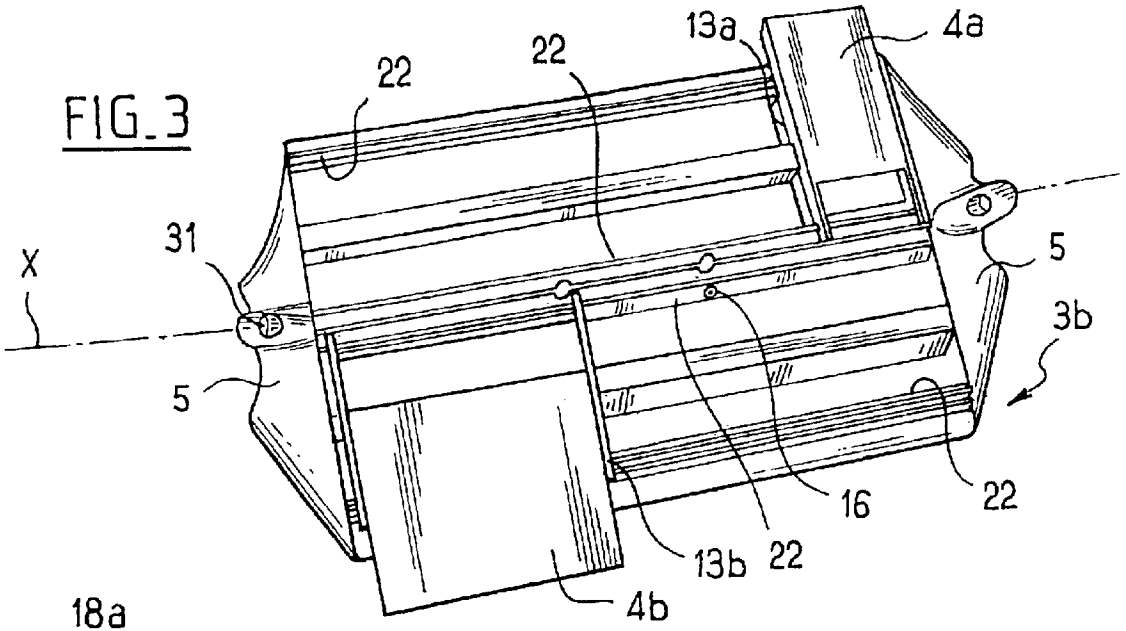
FIG. 3 shows the underside of one of the shelves of the FIG. 1 display unit in isolation.

As can be seen in FIG. 3 in particular, preferably the shelf 3*b* is generally symmetrical about a vertical midplane containing its longitudinal axis X. The same applies to the shelves 3*a* and 3*c*. The bottom face of each shelf 3*a*, 3*b*, or 3*c* carries a pair of runners 22 associated with each retractable flap 4*a* or 4*b*. The runners enable carriages 13*a* and 13*b* respectively associated with the flaps 4*a* and 4*b* to be guided in translation along the axis X to allow the position of the flap to be varied along the longitudinal direction of the shelf. The flap 4*a* can slide relative to the carriage 13*a* in a horizontal direction perpendicular to the axis X, and the same applies to the flap 4*b* relative to the carriage 13*b*. The carriages 13*a* and 13*b* are arranged in such a manner as to enable the respective flaps 4*a* and 4*b* to be moved from a retracted position where each flap is situated fully beneath the shelf, to an extended or deployed position in which each flap is cantilevered out beyond the longitudinal edge of the shelf, so as to enable an article 6 or a sample 7 to be placed thereon.

Where appropriate, the flaps 4*a* or 4*b* can be moved relative to the carriages 13*a* or 13*b* with hard points or stops being obtained by friction or elastic deformation (or another suitable stopping or resistance expedient) so as to enable the user moving the flaps 4*a* and 4*b* to be aware of when they reach their retracted or extended positions.

The body of each shelf 3*a*, 3*b*, and 3*c* can be formed, by way of example, of an aluminum extrusion, however, it is to be understood that various materials or combinations of materials could be used. Each of the shelves includes at least one fastening or mounting arrangement. In the illustrated embodiment, by way of example, each shelf 3*a*, 3*b*, 3*c* receives one or two mounts 5 at its ends enabling it to be mounted on one or two columns 2, as appropriate. The term mount is used broadly herein to refer to an arrangement that can fasten or couple a shelf to a column or support. In the illustrated embodiment, the shelves 3*b* have a mount 5 at each end as can be seen in FIG. 3, whereas the shelves 3*a* and 3*c* have only one mount 5 each, with their opposite ends being merely fitted with endpieces 30, as can be seen in FIG. 2.

Figure 4:
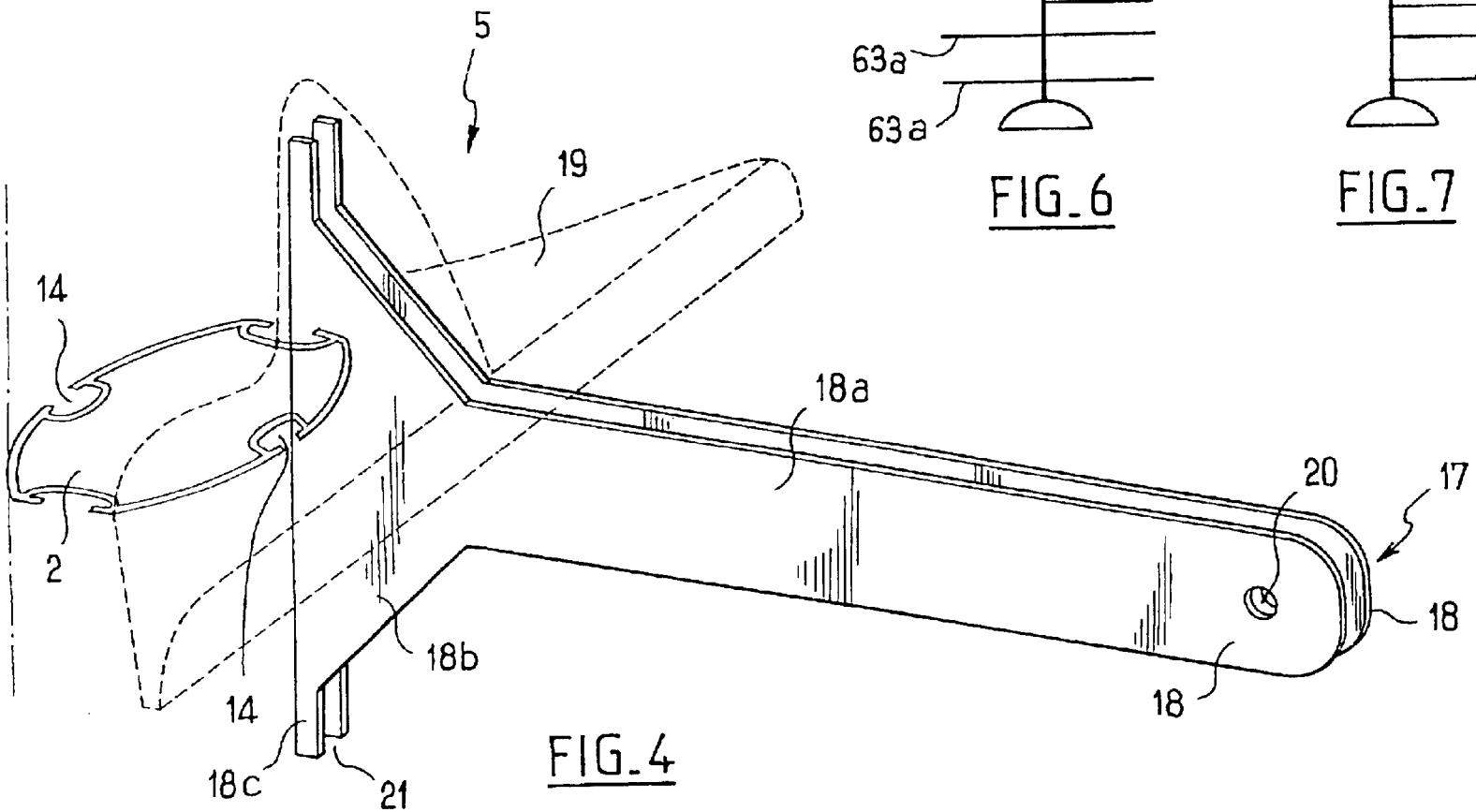
FIG. 4 is a diagrammatic perspective view of a fastening or mounting arrangement for fixing a shelf to the associated column.

According to a preferred form, the mounts 5 are arranged in such a manner as to be capable of taking up the forces associated with supporting the weight of articles 6 placed on the shelves, and for this purpose each mount can have a metal strength member 17 made up of two identical brackets 18 that are spaced apart side by side, as can be seen in FIG. 4.

Figure 5:
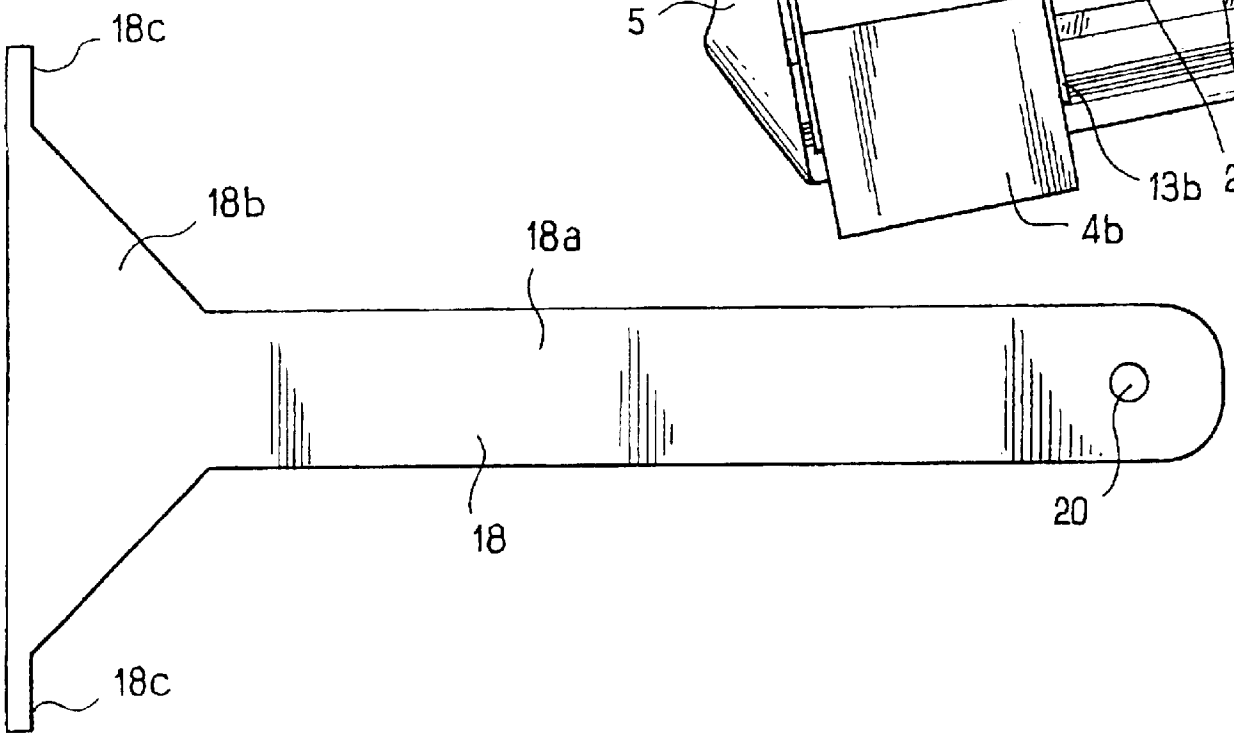
FIG. 5 is a side view of a bracket of the FIG. 4 fastening/mounting arrangement.

FIG. 5 shows a single bracket 18 in isolation. The bracket includes a bearing surface 18*a* for engaging in a groove inside the body of the shelf, for example, and a base 18*b* presenting flats 18*c*. At its end remote from the base 18*b*, the bearing surface 18*a* has a hole 20 suitable for receiving a fixing screw 16 that engages in or extends through the body of the shelf, as can be seen in FIG. 3.

In the illustrated embodiment, in addition to base 18*b*, each mount 5 preferably carries a shell 19 of, e.g., a plastic material which serves as decoration and which masks the strength member 17. The shell 19 has openings 31 for receiving fixing screws (or other suitable expedient) and the shell 19 also serves to provide a junction having a pleasing appearance between a shelf and the corresponding column.

In the example shown, each column 2 is formed as a metal extrusion, e.g. of aluminum, provided with longitudinal grooves 14, as can be seen in FIG. 4. It is to be understood, however, that various materials and manufacturing techniques can be used to form the columns 2. The grooves 14 receive bars that are provided along their length with tapped holes 15 (FIG. 2) into which screws passing through the openings 31 in the mounts 5 can be engaged. These screws can have their heads bearing against the flats 18*c* with their bodies extending into the gap 21 that exists between two brackets 18. The holes 15 are preferably provided at a relatively short pitch so as to provide sufficient choices for determining the height at which each shelf is to be positioned. The pitch in question can thus be sufficiently short to ensure that the majority of the holes 15 remain unoccupied. The coupling of the mounts 5 via screws and holes 5 are disclosed as an example of an advantageous mounting arrangement. However, it is to be understood that other arrangements could also be utilized, for example, with the mount hooking into apertures associated with the columns (or vice versa), and/or with additional support provided by brackets or suspension cables or chains having a suitable decorative appearance. Thus, it is to be understood that various mounting and supporting expedients other than those specifically illustrated herein are possible for coupling the shelves to one or both of the columns.

In the example shown, each of the columns 2 has its base fixed to a stand 9. By way of example, such a stand can include a shell made by rotational molding. According to an optional preferred feature, a pelmet 10 interconnects the top portion of the two columns 2.

In the example shown, the shelves 3*a* and 3*c* are more numerous than the shelves 3*b*, with the shelves 3*b* being fixed between the two columns 2 far enough down to leave a location for receiving a display panel 11 that may carry, for example, an image suitable for showing the articles 6 or promoting the advantages that can be achieved by using the article/product being displayed on the shelves, e.g., utilizing an image. The display panel 11 could also provide a corporate name or logo or other suitable images for arousing interest and/or providing information concerning the articles being displayed in the unit.

Naturally, the invention is not restricted to any particular arrangement of the shelves relative to the columns, nor is it restricted to any given number of shelves or columns.

Figure 7:
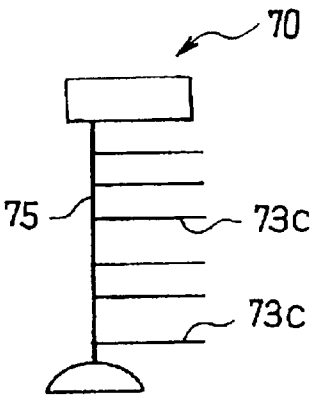
FIGS. 6 and 7 are diagrams showing two possible arrangements, amongst others, for shelves on the columns.
Figure 6:
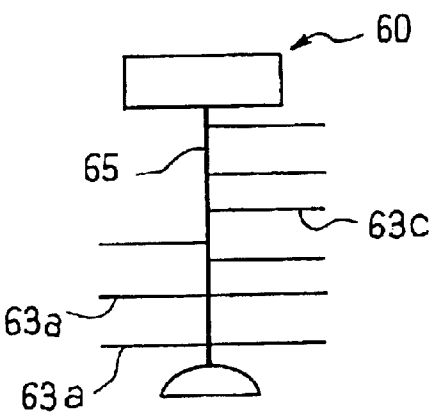

As an example of a few possible variants among many, FIGS. 6 and 7 are diagrams showing display units 60 and 70 each comprising a single column 65 or 75. With such an arrangement, the display unit 60 has two series of shelves 63*a*, 63*c* placed along two opposite sides of the column 65. The display unit 70 has a single series of shelves 73*c* all placed on the same side of the column 75. As shown, the top of the single column arrangement can have a pelmet thereon and/or a display panel for a product image, product information, brand identification or another suitable image.

As should be apparent from the teachings herein, the invention is not limited to the embodiments described. By way of example, the flaps may be retractable other than by sliding, and they may be mounted on the shelves in such a manner as to be capable of pivoting relative thereto, for example. Obviously, numerous modifications and variations of the present invention are possible in light of the above teachings. It is therefore to be understood that within the scope of the appended claims, the invention may be practiced otherwise than as specifically described herein.

What is claimed is:

1. A display unit, comprising:

at least one column;

at least two shelves cantilevered out from said column; and at least one retractable flap carried by one of said shelves;

wherein said one of said shelves has a length and wherein the at least one retractable flap extends along said shelves on a length inferior to the length of said one of said shelves.

2. A display unit according to claim 1, wherein the at least one retractable flap is cantilevered out from one of said shelves, when it is in a deployed position.

3. A display unit according to claim 1, wherein each cantilevered out shelf carries at least one retractable flap.

4. A display unit according to claim 1, wherein each shelf of the display unit carries at least one retractable flap.

5. A display unit, comprising:

at least two columns;

at least two shelves; and at least one retractable flap carried by one of said shelves;

wherein at least one shelf is carried by two columns simultaneously, and wherein the at least two shelves are cantilevered out from at least one of the two columns.

6. A display unit according to claim 5, including a pelmet interconnecting the top portions of the two columns.

7. A display unit according to claim 5, wherein fewer shelves are disposed between the two columns than the number of shelves cantilevered out from each of the columns.

8. A display unit according to claim 5, including a panel between the two columns.

9. A display unit according to claim 1, wherein said at least one retractable flap is movable beneath the associated shelf along a longitudinal direction of said shelf.

10. A display unit according to claim 1, wherein said at least one retractable flap is slidable relative to a support mounted beneath the associated shelf.

11. A display unit according to claim 10, wherein said support is itself slidable along the longitudinal direction of the associated shelf.

12. A display unit according to claim 1, wherein each shelf carries at least two retractable flaps.

13. A display unit according to claim 12, wherein the two retractable flaps are movable in opposite directions to be moved into their deployed motion.

14. A display unit according to claim 12, wherein the two retractable flaps are of different sizes.

15. A display unit according to claim 1, wherein each shelf is symmetrical in shape about a vertical midplane containing a longitudinal axis of said shelf.

16. A display unit according to claim 1, wherein at least one shelf includes at least one groove in its top face, said groove being situated adjacent to one of a front edge and a rear edge of said at least one shelf.

17. A display unit according to claim 16, wherein said at least one shelf carries at least one display element having a bottom edge inserted in said groove.

18. A display unit according to claim 1, including at least one stand fixed to said at least one column.

19. A display unit according to claim 18, wherein said stand comprises a shell made by rotational molding.

20. A display unit according to claim 1, wherein at least one shelf is made at least in part out of aluminum.

21. A display unit according to claim 1, wherein at least one column is made at least in part out of aluminum.

22. A display unit, comprising:

at least one column;

at least two shelves cantilevered out from said column; and at least one retractable flap carried by one of said shelves;

wherein the shelves are fixed to the at least one column by a plurality of mounts, wherein each mount includes a support member and a decorative portion, and wherein said decorative portion is made of a plastic material.

23. A display unit according to claim 22, wherein said support member comprises at least one generally T-shaped bracket.

24. A display unit according to claim 23, wherein said support member comprises two spaced-apart brackets disposed side by side.

25. A display unit according to claim 24, wherein said brackets define between them a space suitable for receiving a body of at least one screw whose head rests against said brackets, in order to hold them in place on the column.

26. A display unit according to claim 22, wherein the plastics material decoration is shaped to fit closely to an outside shape of a column.

27. A display unit, comprising:

at least one column;

at least two shelves cantilevered out from said column; and at least one retractable flap carried by one of said shelves;

wherein said display unit includes first and second columns, and wherein a display panel is disposed between said first and second columns.

28. A display unit as recited in claim 27, further including at least one shelf extending between said first and second columns, wherein said at least one shelf is disposed below at least a portion of said display panel.

29. A display unit comprising:

a first column;

a second column;

a first plurality of shelves, each mounted to said first column with a cantilever mount;

a second plurality of shelves, each extending between and mounted to said first column and said second column;

a display panel disposed between the first and second columns, said display panel having at least one image thereon;

wherein the shelves of the second plurality of shelves are mounted to exactly two columns.

30. A display unit comprising:

a first column;

a second column;

a first plurality of shelves, each mounted to said first column with a cantilever mount;

a second plurality of shelves, each extending between and mounted to said first column and said second column;

a display panel disposed between the first and second columns, said display panel having at least one image thereon;

wherein at least one shelf of said first and second pluralities of shelves includes a retractable flap which is movable between a retracted position and a deployed position, and wherein in said deployed position said retractable flap provides a sub-shelf for holding at least one article.

31. A display unit as recited in claim 30, wherein said at least one shelf includes two retractable flaps.

32. A display unit as recited in claim 31, wherein said two retractable flaps are disposed on opposite sides of said at least one shelf.

33. A display unit as recited in claim 32, wherein said two retractable flaps are movable in a direction transverse to a direction of movement between the retracted position and the deployed position, wherein movement in the transverse direction changes position of the retractable flaps along a longitudinal direction of said at least one shelf.

34. A display unit as recited in claim 30, wherein said retractable flap is movable in a direction transverse to a direction of movement between the retracted position and the deployed position, wherein movement in the transverse direction changes position of the retractable flap along a longitudinal direction of said at least one shelf.

35. A display unit as recited in claim 29, wherein a larger number of said first plurality of shelves are provided than said second plurality of shelves.

36. A display unit as recited in claim 35, further including a third plurality of shelves mounted to said second column with a cantilever mount.

37. A display unit as recited in claim 36, wherein a larger number of said third plurality of shelves are provided than said second plurality of shelves.

38. A display unit as recited in claim 37, wherein at least one shelf of said first, second, and third pluralities of shelves includes a groove for receiving an edge of a display element.

39. A display unit comprising:

a first column;

a second column;

a first plurality of shelves, each mounted to said first column with a cantilever mount;

a second plurality of shelves, each extending between and mounted to said first column and said second column;

a third plurality of shelves mounted to said second column with a cantilever mount;

a display panel disposed between the first and second columns, said display panel having at least one image thereon, wherein at least one shelf of said first, second and third pluralities of shelves includes a first groove and a second groove, wherein said first and second grooves are disposed adjacent opposite sides of said shelf, and wherein said first and second grooves are for receiving an edge of a display element.

40. A display unit as recited in claim 39, wherein at least one of said shelves includes a retractable flap which is movable between a retracted position and a deployed position and wherein in said deployed position said retractable flap can hold at least one article.

41. A display unit as recited in claim 39, wherein at least one shelf of said first and second pluralities of shelves includes a groove for receiving a display element.

42. A display unit as recited in claim 41, wherein at least one of said shelves includes a retractable flap which is movable between a retracted position and a deployed position and wherein in said deployed position said retractable flap can hold at least one article.

43. A display unit as recited in claim 29, further including a pelmet extending from said first column to said second column.

44. A display unit comprising:

a first column;

a second column;

a first plurality of shelves, each mounted to said first column with a cantilever mount;

a second plurality of shelves, each extending between and mounted to said first column and said second column;

a display panel disposed between the first and second columns, said display panel having at least one image thereon;

wherein said display panel further includes a pelmet extending from said first column to said second column, the display panel being at least partially disposed below said pelmet, and wherein at least some of said second plurality of shelves are disposed below said display panel.

45. A display unit as recited in claim 44, further including a third plurality of shelves mounted to said second column with a cantilever mount.

46. A display unit as recited in claim 45, further including a plurality of retractable flaps which are movable between a retracted position and a deployed position, and wherein in said deployed position each of said retractable flaps can hold at least one article.

47. A display unit as recited in claim 46, wherein said plurality of flaps include flaps of at least two different sizes with flaps of different sizes disposed in an alternating fashion with respect to a vertical direction.

48. A display unit as recited in claim 29, further including a plurality of retractable flaps which are movable between a retracted position and a deployed position, and wherein in said deployed position each of said retractable flaps can hold at least one article.

49. A display unit as recited in claim 48, wherein said plurality of flaps include flaps of at least two different sizes with flaps of different sizes disposed in an alternating fashion with respect to a vertical direction.

50. A display unit comprising:

a first column;

a second column;

a first plurality of shelves, each mounted to said first column with a cantilever mount;

a second plurality of shelves, each extending between and mounted to said first column and said second column;

a display panel disposed between the first and second columns, said display panel having at least one image thereon, the display unit further including a pelmet extending forward of the two columns.

51. A display unit comprising:

a first column;

a second column;

a first plurality of shelves, each mounted to said first column with a cantilever mount;

a second plurality of shelves, each extending between and mounted to said first column and said second column;

a display panel disposed between the first and second columns, said display panel having at least one image thereon, the display unit further including at least one stand fixed to at least one column, wherein said stand comprises a shell made by rotational molding.

52. A display unit comprising:

a first column;

a second column;

a first plurality of shelves, each mounted to said first column with a cantilever mount;

a second plurality of shelves, each extending between and mounted to said first column and said second column;

a display panel disposed between the first and second columns, said display panel having at least one image thereon;

wherein the shelves comprise at least one top shelf, wherein the display panel is set back from the shelves and extends under the at least one top shelf.

* * * * *